US005873469A

United States Patent [19]

Stone

[11] Patent Number: 5,873,469

[45] Date of Patent: Feb. 23, 1999

[54] VIBRATING SCREENER

[75] Inventor: Lawrence H. Stone, Rivervale, N.J.

[73] Assignee: Kason Corporation, Millburn, N.J.

[21] Appl. No.: 774,589

[22] Filed: Dec. 30, 1996

[51] Int. Cl.[6] ..... B07B 9/00

[52] U.S. Cl. ..... 209/22; 209/29; 209/250; 55/338; 55/459.1

[58] Field of Search ..... 209/21–25, 28, 209/29, 134, 135, 139.2, 146, 147, 148, 250, 466; 55/338, 447, 459.1

[56] References Cited

U.S. PATENT DOCUMENTS

| | | | |
|---|---|---|---|
| 526,334 | 9/1894 | Volm | 209/22 |
| 1,661,299 | 3/1928 | Peron | 209/29 |
| 2,721,510 | 10/1955 | Caswell | 209/29 |
| 3,796,312 | 3/1974 | Krolopp et al. | 209/22 X |
| 4,755,284 | 7/1988 | Brooks et al. | 209/466 X |

FOREIGN PATENT DOCUMENTS

| | | | |
|---|---|---|---|
| 1604495 | 11/1990 | U.S.S.R. | 209/29 |

*Primary Examiner*—Tuan N. Nguyen
*Attorney, Agent, or Firm*—Stanley J. Yavner

[57] ABSTRACT

An improved vibrating screener is disclosed as including an inlet system which provides for tangential input of the material to be processed by the screener. A spacing frame is provided in connection with the tangential inlet in order to separate materials by disengaging particles from the input material as it spirals down the side of the spacing frame and feed tray. During the spiraling down action, the material decreases in velocity. During the separation process, an external loop is used for by-passed air, thereby providing the full diameter of the machine for the by-pass screen, to avoid by-pass screen blinding. The by-passed air can then be used to pick up the screened powder at the bottom of the unit; or, the by-passed air is reintroduced below the separating screen to flush the machine free of screened product.

4 Claims, 2 Drawing Sheets

VIBRATING SCREENER

FIELD OF THE INVENTION

This invention relates primarily to machines for size separation of particulate material for use within a dilute phase pneumatic conveying system in the food, feed and chemical processing industries, and for other applications.

BACKGROUND OF THE INVENTION

Generally, sifters utilized within a dilute phase pneumatic conveying system, include, for instance, a pressurized container with a screen or screens of desired mesh size therein. Commonly, the container is mounted in such a manner that it is vibrated to cause the materials provided at the input of the container to move across the screen and thereby to effect the sifting action.

As shown and described by Krolopp, et al, U.S. Pat. No. 3,796,312, issued Mar. 12, 1974, there are essentially three courses of flowthrough in a typical screener; one for oversized material, a second for undersized or desired material and a third for air flow used to convey the undersized product. As shown by the Krolopp system, air and solid material traverse an inlet pipe at the top center of the container. As air enters into the container, since the container is much larger than the inlet pipe, such air will be reduced in velocity as it travels downward into the container. Nevertheless, the particulate materials moving with the air are still travelling at full velocity, and are thereby impinging the screen at high velocity sufficient to break up some of the unwanted contaminants (bugs, pieces of glass, pieces of trash, etc.) so that they pass through the screen mesh. As to the contaminants that do not pass through the screen, they are forced to the periphery of the screen in the same manner as oversized material.

Another feature shown by the Krolopp structure is the use of a by-pass screen for by-passing the converying air, which because of the design turns out to be very small in area, which allows it to possibly become plugged.

OBJECTS AND SUMMARY OF THE INVENTION

Accordingly, a primary object of the present invention is to provide an air and material inlet orientation for a vibrating screener operating in a dilute phase pneumatic conveying system, which enables the prevention of unwanted contaminants passing through the screens, or breaking up upon entering the screener due to impinging on internal components at conveying velocity.

A further and more particular object is to provide a tangential inlet for air and material to be screened and the use of an external carrying system in order for the air to by-pass the screening surface, thereby to enable the use of the full diameter of the system for the by-pass screen.

These and other objects of the present invention are provided by a screener which features one or more vibratory motors, a generally cylindrical container, a generally circular by-pass screen and at least one generally circular operating screen mounted within the container, a by-pass screen for enabling free airflow and acting as a barrier for preventing undesired input material from mixing with the by-passed airstream therethrough, and the operating screen for separating oversized material from desired material. The container provides a tangential input pipe for admitting input material to the container in a tangential direction with respect to the cylindrical axis of the container. The inlet pipe of the container is positioned and arranged in a manner so that inlet materials do not impact on either screen or on any wall; but instead, the stream of air and solids admitted to the container generally form a cyclone, whereby in a foodstuff application for the vibrating screener, such as flour, unwanted bugs and other trash are not degenerated and mixed with the selected input material, and the pressure drop on the by-pass screen is maintained at a sufficiently low level to prevent plugging on that screen thereby to avoid damaging the screen.

The channel for carrying the air from above the by-pass screen to below the operating screen is exterior to the container in order to avoid the increased structural cost that would be attendant to internal channelling, but could be internal, if required.

Other objects, features and advantages of the present invention will become apparent by reference to the following detailed description of the preferred, but nonetheless illustrative, embodiment of the present invention, with reference to the accompanying drawings, wherein:

DETAILED DESCRIPTION OF THE PREFERRED EMBODIMENT

Figure 1:
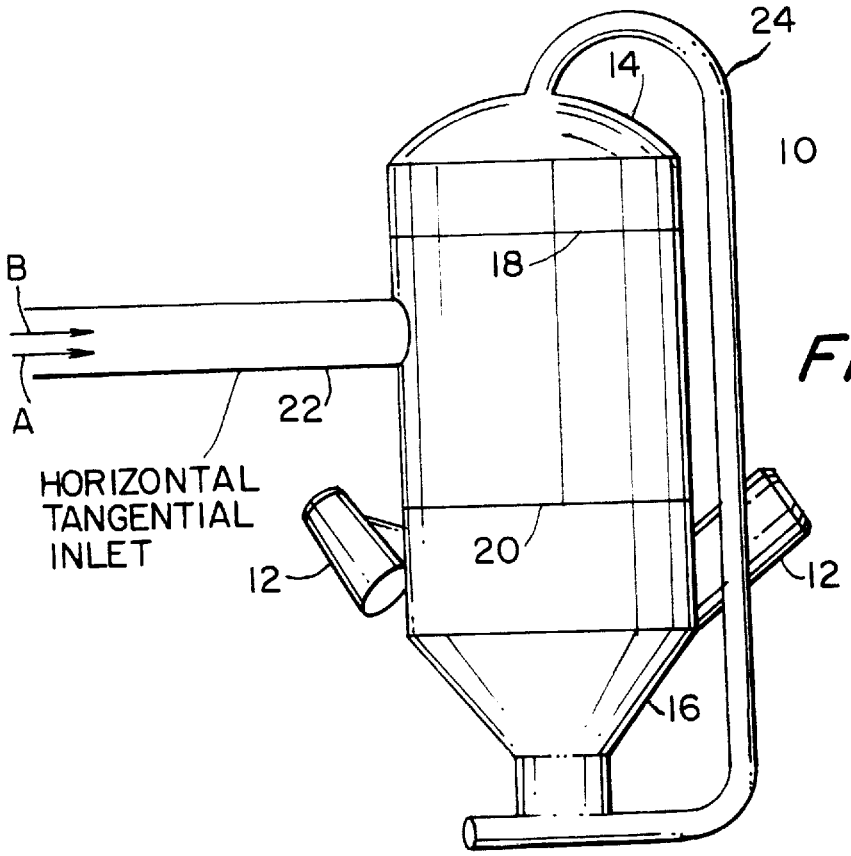
FIG. 1 is a simplified schematic diagram of a vibrating screener according to the present invention.
Figure 2:
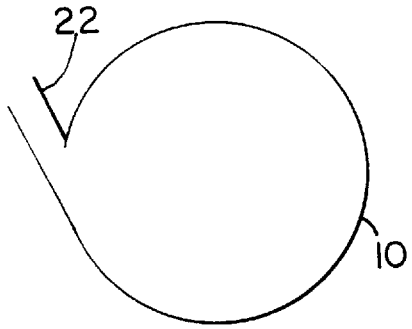
FIG. 2 is a partial view of the screener of FIG. 1 showing particularly the horizontal, tangential inlet pipe of the vibrating screener and the location and orientation thereof.

As shown in FIG. 1, a generally cylindrical container 10 has mounted thereon, for providing vibrating motion, a pair of eccentrically mounted motors 12. The motors, of course, are provided, as shown, for illustrative purposes only; but are among a number of vibration sources commonly used in this type of equipment for provided vibrating motion.

The container is capped at the top, for illustrative purposes, by a domed inlet 14, and on the bottom by a funnel outlet 16. Within the container are a pair of screens 18, 20. The first being a by-pass screen 18 and the other being an operating screen 20, having identical apertures. As is true with respect to screening equipment of this type, a plurality of operating screens 20 are sometimes used, but only one such screen is shown in this preferred and illustrative embodiment.

Most particularly, tangential to axis of the circular cross-section of the generally cylindrical container 10 is an inlet pipe 22, whose function it is to bring, for instance, flour within the container for the purpose of being screened in order to produce a uniform and homogeneous powder of the flour for purposes of various uses, as are well known in this field. The inlet pipe is shown in FIGS. 1, 2, 3 and 4.

Figure 3:
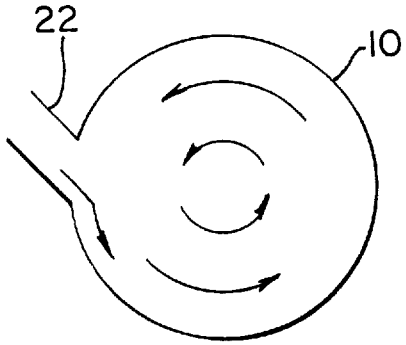
FIG. 3 is a schematic representation of air flow in the vicinity of the inlet pipe.
Figure 4:
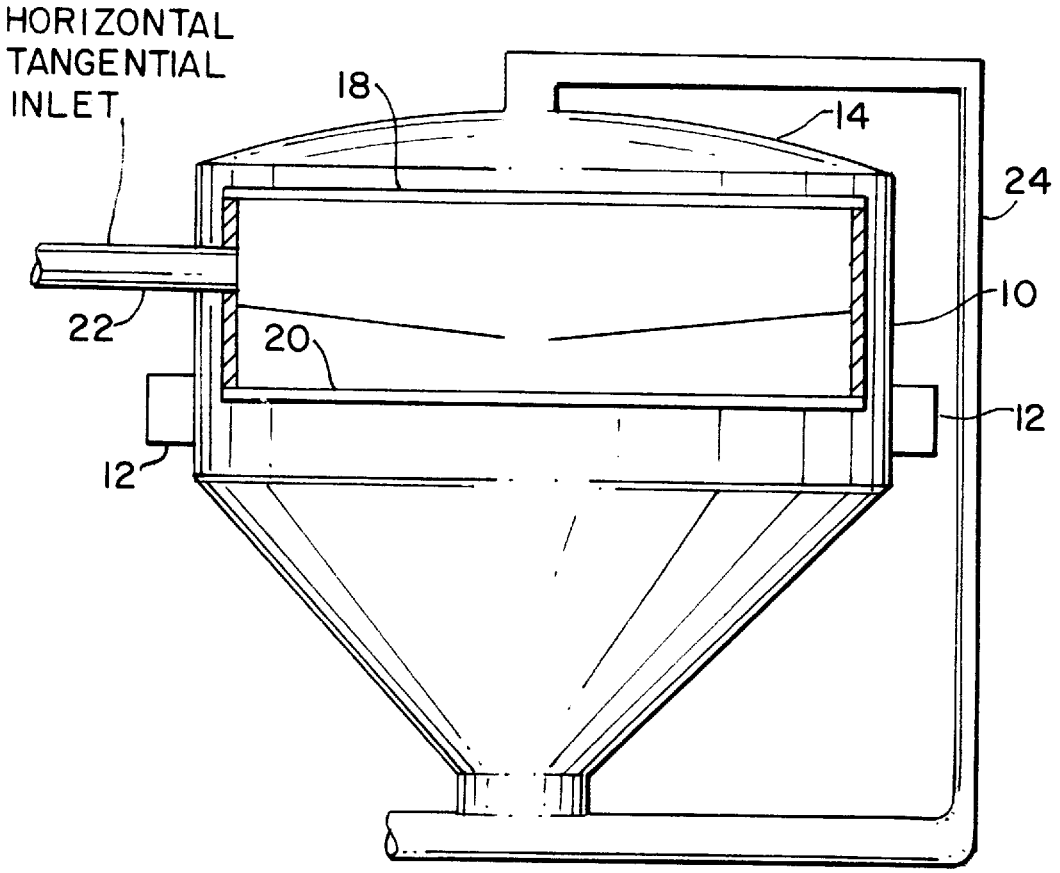
FIG. 4 is an elevational view, partially schematic, of a preferred embodiment of the present invention.

The material input of a particulate is represented by the arrow designated A, which, for the purposes of this detailed description contains unwanted contaminants such as bugs and various types of trash. Also inserted to the machine through inlet pipe 22 is a stream of air designated by the arrow labelled B which enters the container 10, with the particulate A through inlet 22. Unlike prior art vibrating screeners, as the air B and particulate A enter the container, the velocity of air B slows as it enters container 10, and, with the particulate A, forms a cyclone-type of flow inside of the container, as illustrated in FIG. 3. By this means, there is no significant impact on any screen or any wall of the container, as would be the case in terms of the material that flows into a top container inlet pipe with air, as in the prior art. For example, a typical air inlet line is three inches in diameter, and enters into a forty-eight inch diameter chamber. The air velocity slows down immediately, but the particulates conveyed in the air are still travelling at full velocity, probably about five thousand feet per minute. Therefore, bugs, other trash, etc., which might be mixed in with the input particulates, disintegrate upon impact with the screen located below the inlet. Such contaminants break up enough to possibly pass through the screening media. With the tangential input of the present invention, direct impact is far less likely, if not impossible.

As the screening operation occurs with the present invention, the full use of the by-pass screen is enabled, without significant chance for plugging or blinding as with the prior art. It has been found, with use of the present invention, that the major concern with use of this type of system is the input of bugs, wherein wings and legs of bugs have a tendency to move upwardly in the air flow (FIG. 3), and these and the other trash and oversized material are conveniently and consistently separated at the operating screen 20. The upward flow of wings, etc., as mentioned previously is enabled by the flow of air upwardly into exterior channel 24, through by-pass screen 18, which prevents the carryover of foreign material. The use of such exterior channel has proven to both enable the use of a full container, generally circular, by-pass screen and generally costs less than interior channels for the same use. The air flow through the exterior channel is reintroduced to the lower portion of container 10, at bottom funnel discharge 16 to re-entrain the screened product, and continue pneumatic conveying of course, the reintroduction takes place either at the very base of the funnel 16, as shown, or upwardly of the base along the slanted wall (not shown).

Pursuant to the foregoing, the present invention has been described with particular reference to a preferred embodiment. However, for example, a different vibratory motor scheme would, of course, function appropriately with the invention as described. Therefore, the invention is to be limited in scope only by the following claims:

What is claimed is:

1. A vibrating screener for use with a vibration-imparting mechanism comprises a generally cylindrical container having a generally circular cross-section and including a first, by-pass screen, a second, operating screen, each being general disc-like in shape and having a top and bottom surface, an inlet pipe located between said screens for entering to said container air and particulate material in a direction generally tangentially to the generally circular cross-section of said cylindrical container, said entering air exiting from said container above the top surface of said by-pass screen, and re-entering said container below the bottom surface of said operating screen.

2. The invention according to claim 1, wherein said container further includes an exterior channel into which said exiting air enters and in which said exiting air is conveyed to re-enter said container.

3. The invention according to claim 1, wherein said by-pass screen extends generally throughout said generally circular cross-section.

4. The invention according to claim 1, wherein said vibration-imparting mechanism comprises a pair of motors mounted generally on opposite sides of said generally cylindrical container.

* * * * *